United States Patent [19]

Oguri et al.

[11] Patent Number: 4,872,385

[45] Date of Patent: Oct. 10, 1989

[54] AUTOMATIC RHYTHM PERFORMING APPARATUS WITH MODIFIABLE CORRESPONDENCE BETWEEN STORED RHYTHM PATTERNS AND PRODUCED INSTRUMENT TONES

[75] Inventors: Shigenori Oguri; Kosei Terada, both of Hamamatsu, Japan

[73] Assignee: Yamaha Corporation, Hamamatsu, Japan

[21] Appl. No.: 14,706

[22] Filed: Feb. 13, 1987

[30] Foreign Application Priority Data

Feb. 14, 1986 [JP] Japan ..... 61-28919

[51] Int. Cl.[4] ..... G10H 1/40

[52] U.S. Cl. ..... 84/635; 84/DIG. 12

[58] Field of Search ..... 84/1.01, 1.03, 1.28, 84/DIG. 12

[56] References Cited

U.S. PATENT DOCUMENTS

| | | | |
|---|---|---|---|
| 4,217,804 | 8/1980 | Yamaga et al. | 84/1.03 |
| 4,275,634 | 6/1981 | Imamura et al. | 84/1.03 |
| 4,282,788 | 8/1981 | Yamaga et al. | 84/1.03 |
| 4,333,375 | 6/1982 | Sogoh | 84/1.01 |
| 4,344,345 | 8/1982 | Sano | 84/1.03 |
| 4,495,846 | 1/1985 | Williams | 84/1.01 |

FOREIGN PATENT DOCUMENTS

| | | |
|---|---|---|
| 54-48515 | 4/1979 | Japan . |
| 59-191 | 1/1984 | Japan . |

*Primary Examiner*—Arthur T. Grimley
*Assistant Examiner*—John G. Smith
*Attorney, Agent, or Firm*—Spensley, Horn, Jubas & Lubitz

[57] ABSTRACT

In an automatic rhythm performing apparatus, pattern memory stores rhythm pattern data of respective rhythm patterns for respective rhythm instrument tones as identified by channel numbers. Selected rhythm pattern data are read out together with the channel numbers and are supplied to corresponding tone generation channels for respective instrument tones according to the selected rhythm kind. There is provided a rewritable data memory storing channel alteration data for altering the channel number included in the read-out pattern data to another channel number. The rhythm pattern data read out from the pattern memory are supplied, as modified by the channel alteration data read out from the rewritable data memory, to the tone generation channels of the alteredly designated channel number. The channel alteration data of the data memory are rewritten by the manipulation of keys in the performance keyboard, whereby the rhythm patterns of the instrument tones are easily altered.

4 Claims, 10 Drawing Sheets

AUTOMATIC RHYTHM PERFORMING APPARATUS WITH MODIFIABLE CORRESPONDENCE BETWEEN STORED RHYTHM PATTERNS AND PRODUCED INSTRUMENT TONES

BACKGROUND OF THE INVENTION (a) Field of the Invention

The present invention relates to an automatic rhythm performing apparatus arranged so that the types of rhythm tone generators representing a variety of musical rhythm instruments for constituting various rhythm tones can be altered as desired by its user, to thereby realize diversified automatic rhythm performances.

(b) Description of the Prior Art

As a conventional automatic rhythm performing apparatus, there is known, for example, the one which is of the arrangement that rhythm pattern data for respective rhythm timings of individual percussion instruments for either a singular or plural rhythm kind or kinds are memorized so that pattern pulses are outputted in accordance with a rhythm pattern datum corresponding to the rhythm kind selected by, for example, a rhythm selection switch, and that a rhythm tone generator corresponding to each pattern pulse is driven to obtain rhythm tones (Japanese Patent Preliminary Publication No. 59-191).

In such a conventional automatic rhythm performing apparatus as mentioned above, the types of percussion instruments which constitute a group of musical instruments designated in accordance with the respective rhythm kinds are predetermined fixedly, i.e. the rhythm patterns and the rhythm tone generators are provided to have a fixed one-for-one correspondency once a particular rhythm has been selected, so that there has been the inconvenience that it has been difficult to realize further diversification of the respective tones for the selected rhythm in automatic rhythm performances.

Furthermore, there is known an automatic rhythm performing apparatus comprising a random access memory storing arbitrarily composed rhythm patterns, rhythm pattern composing switches, etc. and arranged so that its user is allowed to freely compose a rhythm pattern desired by the user (Japanese Patent Preliminary Publication No. 54-48515).

However, in this conventional automatic rhythm performing apparatus, while the user has a freedom in setting a desired rhythm pattern according to his or her composition, there is the inconvenience represented by the relative difficulty in the operation of loading rhythm pattern informations.

SUMMARY OF THE INVENTION

In view of the above-mentioned problems encountered in the conventional automatic rhythm performing apparatuses, it is the object of the present invention to realize a further diversification of automatic rhythm performance by the provision of an arrangement that, in an automatic rhythm performing apparatus, the types, the number, etc. of the tone generators which represent respective percussion instruments and constitute respective rhythm tones are easily set by the user of this apparatus.

More particularly, the above-mentioned object is attained according to the present invention by the provision of an automatic rhythm performing apparatus which comprises, as shown in the junctional block diagram of FIG. 1 representing the general concept of the present invention, rhythm pattern memory (A), rewritable instrument data memory means (B), rhythm pattern reading-out means (C), instrument tone producing means (D) and instrument data inputting means (E).

The rhythm pattern memory means (A) stores a plurality of rhythm pattern data, each of which indicates rhythm timings for a corresponding rhythm instrument tone and include channel designation datum for a tone generator channels as allotted according to rhythm kinds, respectively.

The data memory means (B) stores channel alteration data for altering the channel designation datum in said rhythm pattern data.

The rhythm pattern data read out from the rhythm pattern memory means (A) by the rhythm pattern reading-out means (C) are supplied, as modified by the channel alteration data read out from the data memory means (B), to the rhythm tone producing means (D) corresponding to the selected tone generator channel having the alteredly designated channel number.

The instrument data inputting means (E) is utilized in loading the channel alteration data into the data memory means (B), or to rewrite the stored such data.

In the preferred embodiment of the present invention, the above-mentioned instrument data memory means (B) stores said channel alteration data for each rhythm kind. Also, the instrument tone producing means (D) produces rhythm instrument tones in a time division multiplexing fashion. In addition, the instrument data inputting means (E) utilizes keys of the music performance keyboard to input the data.

The automatic rhythm performing apparatus of the present invention having the above-briefed arrangement functions in such a way that, by the depression of a key or keys of the keyboard, the channel alteration data which has been preliminary assigned to the keys, respectively, is written in the instrument data memory means (B). Thus, by a very simplified operation, a rhythm tone generator which is driven based on a rhythm pattern can be freely switched over from one to another and set, making it possible for the user to realize a further diversification of automatic rhythm performances.

DETAILED DESCRIPTION OF THE PREFERRED EMBODIMENT

Description will hereunder be made of an embodiment of the present invention by referring to the accompanying drawings.

(I) Overall Construction of the Embodiment

Figure 1:
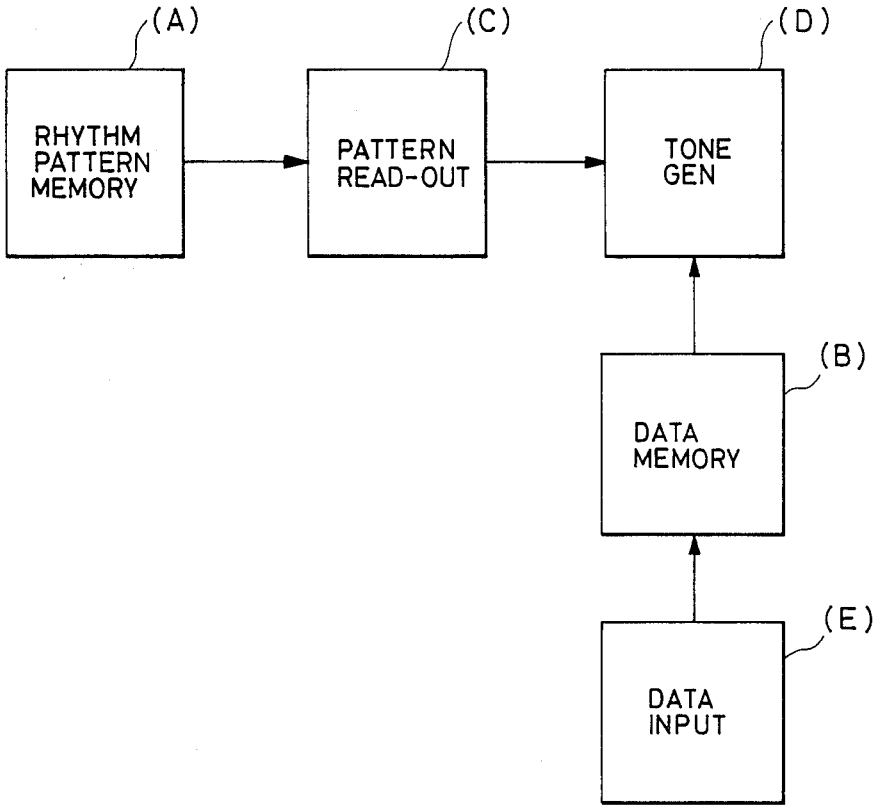
FIG. 1 is a functional block diagram showing the general concept of the present invention.
Figures 2, 3:
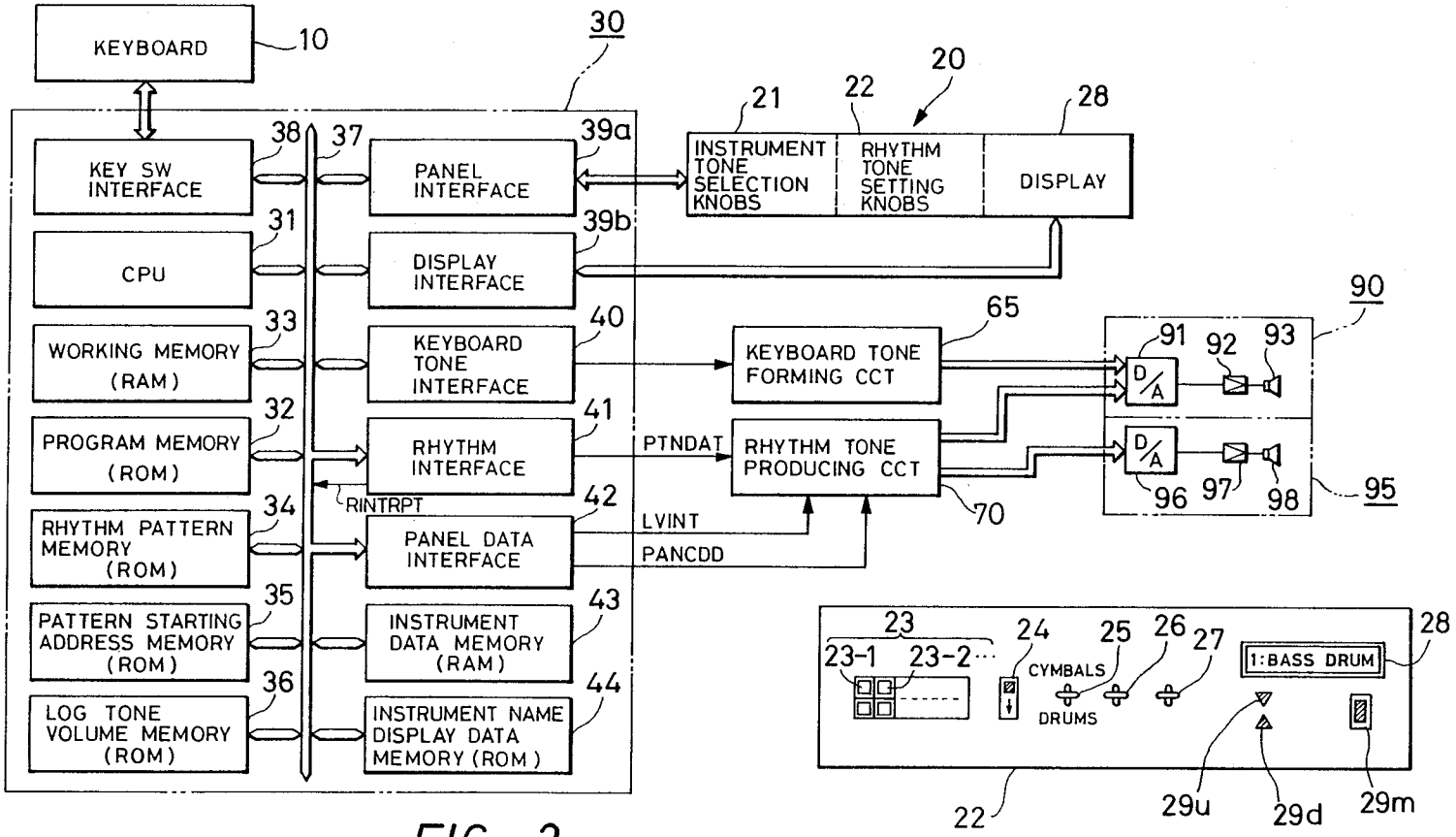
FIG. 2 is a block diagram showing the arrangement of the automatic rhythm performing apparatus according to an embodiment of the present invention.
FIG. 3 is an illustration showing the arrangement of respective manipulating knobs or buttons provided on the control panel of the apparatus shown in FIG. 2 for the selection of rhythms.

FIG. 2 shows the construction of an electronic musical instrument to which the automatic rhythm performing apparatus of the present invention is applied. In FIG. 2, the keyboard unit generally indicated at 10 comprises an upper keyboard (UK) having keys for manual operation, a lower keyboard (LK) having keys for manual operation, a pedal keyboard (PK) having keys for pedal operation, and like keyboards as required, to generate key depression informations (information signals) as well as key release informations in accordance with key operations on these keyboards as performed by the player (user). A control panel 20 is provided with instrument tone selection manipulating knobs 21, rhythm tone setting manipulating knobs 22, a display unit 28 and like parts, to generate such informations concerning the state of actuation of the manipulating knobs as the selection of instrument tones, the selection of rhythm kinds and the selection of rhythm instruments. A control unit 30 scans the keyboard unit 10 and the control panel 20 to take in the informations concerning the keys and the informations concerning the manipulating knobs which have occurred, and based on these informations, delivers out various data concerning keyboard tones and rhythm tones via the keyboard tone interface, rhythm interface and like parts. A keyboard tone forming circuit 65 is inputted with data concerning keyboard tones supplied from the control unit 30 and forms keyboard tone data for a plurality (e.g. ten (10)) of time-divisional channels, and these resulting data generate time divisional multiplexed keyboard tone signals. A rhythm tone generating circuit 70 is inputted with data concerning rhythm tones from the control unit 30, and forms tone signals of a total of eight (8) types of percussion instruments, i.e. one (1) kind of percussion instrument tone for each of the eight (8) time-divisional tone-generation channels, and outputs these percussion instrument tone signals by allotting them to the central loudspeaker and to the left loudspeaker for every tone generator to match the intended percussion instrument and rhythm kind. The keyboard tone signals, and those percussion instrument tone signals which are directed for the central loudspeaker are converted to sound signals via a central sound system 90 comprising a D/A converter 91, an amplifier 92 and a loudspeaker 93, while the percussion tone signals for the left loudspeaker are converted to sound signals via a left sound system 95 comprising a D/A converter 96, an amplifier 97 and a loudspeaker 98, and thus these tone signals, are sounded out from the respective loudspeakers.

Description will hereunder be made of the details of the respective constituting parts of the apparatus.

(1) Manipulating knobs 22 for rhythms

FIG. 3 shows the layout, on the control panel 20, of various kinds of manipulating knobs for rhythms. In FIG. 3, the rhythm selection switch group 23 consisting of switches 23-1, 23-2, . . . . , is intended to select rhythm kind such as "march", "waltz", "swing", etc.

A start-stop switch 24 is assigned to control the starting and stopping of a rhythm.

A balance setting knob 25 is intended to set the tone volume ratio between the tone volume of the instruments of the drum family and the tone volume of the cymbal (noise) family instruments.

A total volume 26 is intended to set the tone volume of the rhythm (mixing ratio of the rhythm tones relative to the keyboard tones).

A tempo setting knob 27 is intended for setting the tempo of an automatic rhythm.

These balance setting knob 25, total volume 26 and tempo setting knob 27 may be provided in the form of, for example, a unit which is a combination of a multiple-staged digital switches or a variable resistor applied with a voltage thereacross and an A/D converter for performing A/D conversion of the voltage at a slidable terminal of said variable resistor.

A display unit 28 is to visually indicate a tone generator channel corresponding to the rhythm kind being selected and the type of the musical instrument for said channel.

Also, a rhythm instrument change-mode selection switch **29*m*, an up-switch 29*u* and a down-switch 29*d*** are manipulating knobs for altering the type, number, etc. of the musical instruments which generate tones of respective rhythms.

(2) Control unit 30

In FIG. 2, the control unit 30 is comprised of a central processing unit (CPU) 31 having parts such as a program counter (PC), an A-register (A), an X-register (X) and a Y-register (Y), a program memory 32, a working memory 33, a rhythm pattern memory 34, a pattern start address memory 35, a logarithmic tone volume memory 36, a bus line 37, a key switch interface 38, a panel interface **39*a*, a display interface 39*b*, a keyboard tone interface 40, a rhythm interface 41, a panel data interface 42, a musical instrument data memory 43 and a musical instrument name display data memory 44, and like parts. These respective control unit-constituting parts are connected to each other via the bus line 37** as illustrated.

The program memory 32 is comprised of a Read Only Memory (ROM), which stores the control program of CPU 31.

The working memory 33 is comprised of a Random Access Memory (RAM), and it locally has a working area intended to temporarily store various kinds of data which are generated when the CPU 31 carries out the control program. This working area is constituted by such registers, flags, etc. as shown in Table 1. It should be noted here that, in the following description, the respective registers and their contents of memory are each indicated by same label names of their own. For example, the beat count register and its contents are both expressed by the same label HKPE. Also, in Table 1, the tempo register TEMPO, the total tone volume register TOTLEV and the rhythm kind register RHYPTN store various informations concerning the tempo setting knob 27 of the manipulating knob group 22 for rhythms and concerning the manipulating knobs for the total volume 26, and of those for the rhythm selection switches 23, respectively. Also, the drum family tone volume ratio register RHDLEV and the cymbal (noise) family tone volume ratio register RHCLEV store the informations coming from the balance setting knob 25 concerning the corresponding manipulating knobs.

TABLE 1

| Names | Labels | Capacity |
|---|---|---|
| Automatic rhythm tempo data register | TEMPO | 1 |
| Total tone volume register | TOTLEV | 1 |
| Drum family tone volume ratio register | RHDLEV | 1 |
| Cymbal family tone volume ratio register | RHCLEV | 1 |
| Rhythm kind register | RHYPTN | 1 |
| Beat count register | HKPE | 1 |
| Rhythm run flag | RHYRUN | 1 |
| Tempo counter | TMPCNT | 1 |
| Intra-measure timing counter | TIMING | 1 |
| Maximum timing register | TMPMAX | 1 |
| Beat-end/return flag | RHHEND | 1 |
| Rhythm starting address register | RHYROM | 2 |
| Pattern pointer | RHPNT | 1 |
| Channel number counter | CHNCNT | 1 |

Figure 4:
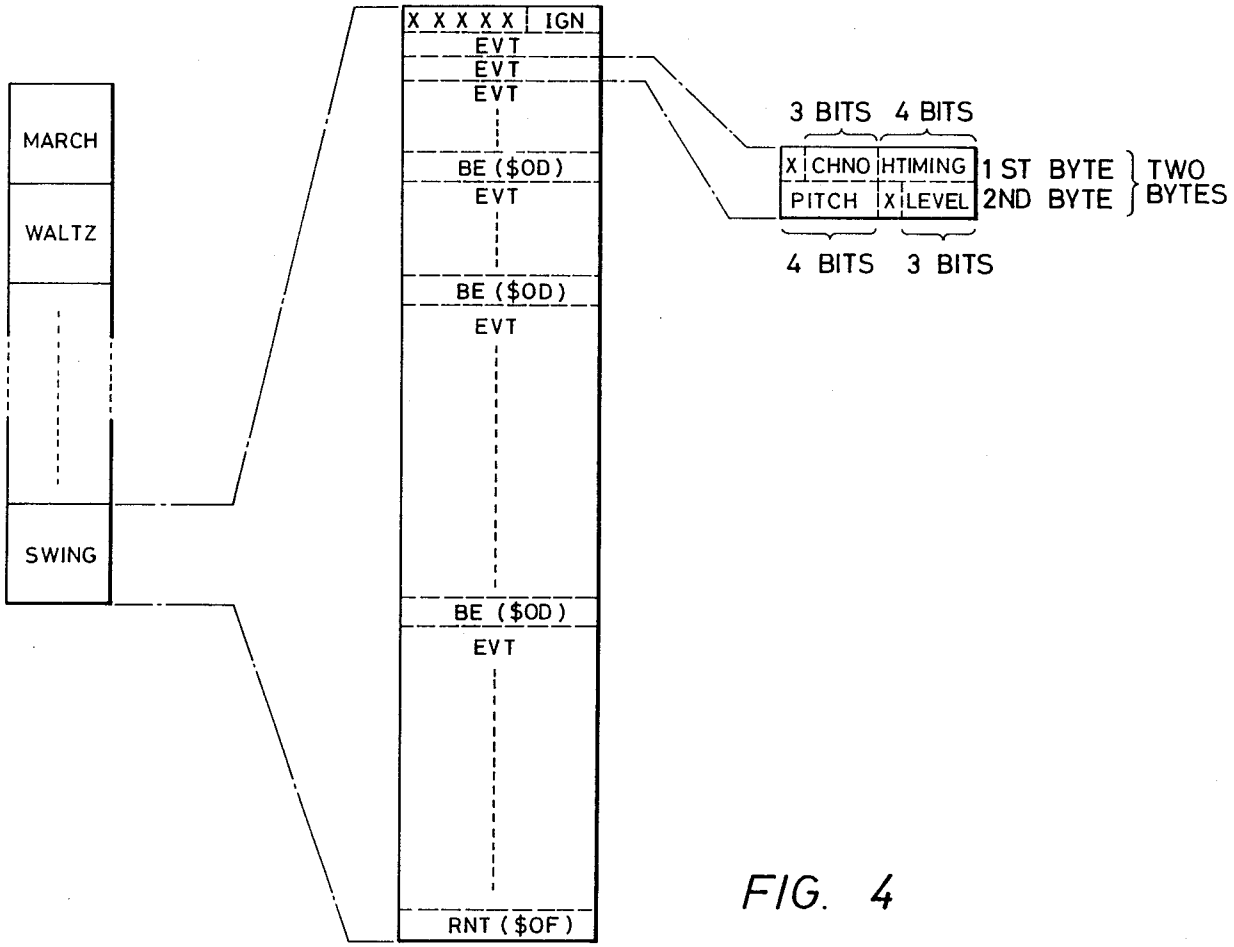
FIG. 4 is a diagram showing the arrangement of data stored in the rhythm pattern memory provided in the a of FIG. 2.

The rhythm pattern memory 34 is comprised of a ROM, and as shown in FIG. 4, stores rhythm patterns for respective rhythm kinds such as "march", "waltz", "swing", etc. As shown on an enlarged scale in FIG. 4, these rhythm patterns each stores musical instrument group number data IGN in the top (starting) address, followed by several event data EVT concerning the rhythm tones requiring pronunciation within every one beat, and a beat-end data BE comprised of data "OD" in hexadecimal notation (hereinafter to be mentioned as "$OD"), and further at the end of each rhythm pattern, a return data (measure-end data) RNT ($OF).

The electronic musical instrument shown in FIG. 2 is so constructed as to pronounce rhythm tones at timings of a timing unit consisting of one (1) sub-beat, i.e. 1/12 of one beat. Also, the event data EVT stored in the rhythm pattern memory 34 is memorized in the order of the intra-beat timings which are indicated by these sub-beats. The above said event data EVT is such that, as shown in FIG. 4, two (2) bytes of 8-bit memory are used in such a way that the less significant 4 bits (4th-1st bits) of the first byte store the intra-beat timings HTIMING at which an event is generated; 7th-5th bits thereof store the channel numbers CHNO for forming tone-generators (musical instruments); upper four (4) bits of the second byte (8th-5th bits) store the pitches PITCH of the percussion instrument which is produced at said intra-beat timings; 4-th bit is an empty bit; 3rd-1st bits store the data representing the level LEVEL of the tone mentioned on the music score for the abovesaid percussion instrument, i.e. either "ff" or "pp" of the level of the tone of the percussion instrument which is produced at said timings. The beat-end data BE indicates the boundary between a beat and its adjacent beat. The return data RNT indicates the rearmost end of a rhythm pattern (which, in case the rhythm is of one bar pattern, is the end of a bar). Also, these beat-end data BE and return data RNT indicate that there is no generation of an event, i.e. no generation of a rhythm tone within those beats subsequent to the intra-beat timing shown in the immediately-preceding event data EVT.

In FIG. 2, the pattern starting address memory 35 stores the starting addresses of the rhythm patterns of respective rhythm kinds stored in the rhythm pattern memory 34, and is a conversion ROM for outputting the respective rhythm pattern starting addressees upon being loaded with the contents RHYPTN of the rhythm kind register.

The logarithmic tone volume memory 36 is a conversion ROM for performing logarithmic conversion of the total tone volume TOTLEV as well as the drum family tone volume ratio RHDLEV and the cymbal family tone volume ratio RHCLEV. The above-mentioned respective tone volume and tone volume ratios are subjected to calculation after being logarithmically converted, and they are delivered out as cymbal family tone loudness NLEV and drum family tone loudness DLEV, both being comprised of eight (8) bits, respectively, to a rhythm tone producing circuit 70 via the panel interface 42. Here, the cymbal family tone volume NLEV is obtained as a product of the total tone volume TOTLEV and the cymbal family tone volume ratio RHCLEV. However, because they are subjected to logarithmic conversion in the abovesaid logarithmic tone volume memory 36, the cymbal family tone volume NLEV can be calculated readily and quickly as the sum of these logarithmic values.

The bus line 37 is comprised of a data bus (DB) and an address bus (ADB), and connects CPU 31 to the respective memories 32–36 and to the respective interfaces 38, 39*a*, 39*b*, 40–42. CPU 31 and these memories 32–36 and interfaces 38, 39*a*, 39*b*, 40–42 perform receipt and delivery of data via the bus line 37.

The rhythm interface 41 performs such operations as: temporarily storing the data concerning rhythm tone generators as outputted by CPU 31; converting the data stored in the rhythm pattern memory 34 to serial data PTNDAT by a command signal from CPU 31 and transferring same to the rhythm tone producing circuit 70; and generating an interrupt signal RINTRPT to cause CPU 31 to perform data transfer processing on an interrupt basis when loaded with a rhythm start signal coming from CPU 31 and thereafter for every sub-beat.

The details of the rhythm interface 41 will be described later.

In FIG. 2, the panel data interface 42 functions in such a way that it performs logarithmic conversion and calculation of the total tone volume TOTLEV as well as the drum family tone volume ratio RHLEV and the cymbal family tone volume ratio RHCLEV which have been read out and taken in by CPU 31 from the total volume 26 and from the balance setting knob 25, respectively, of the rhythm manipulating knobs 22, and that it converts the resulting cymbal family tone volume CLEV and drum family tone volume DLEV, both being of eight (8) bits, to serial data LVINT of 16 bits, and delivers same to the rhythm tone producing circuit 70, and along therewith it converts the instrument group number data IGN read out from the rhythm pattern memory 34 to serial data PANCDD, and delivers same also to the rhythm tone producing circuit 70.

The instrument data memory 43 is comprised of a RAM storing informations concerning the types of musical instruments allotted for each rhythm. The contents of this memory can be rewritten by the manipulation of, for example, the above said instrument change-mode switch 29*m*, up-switch 29*u* and down-switch 29*d*. In this instant embodiment, the instrument data memory 43 stores the altered channel numbers CHNO* corresponding to the values of the rhythm kind RHYPTN and of the channel number counter CHNCNT. In the rhythm tone producing circuit 70 which will be described later, there i formed a corresponding instrument tone signal based on the abovesaid altered channel number CHNO*, the instrument group number ING and the like.

It should be noted here that the above-mentioned instrument groups are each comprised of, for example, eight (8) types of percussion instruments allotted one for each of, for example, eight (8) channels for each group of instruments. There are, for example, eight (8) instrument groups which are designated by the respective instrument group numbers. A rhythm kind which is to be produced by using the tones of the percussion instruments belonging to each group is allotted to each of the respective instrument groups. As the informations concerning such musical instrument groups, there are stored in the memory of, for example, the rhythm tone producing circuit 70 such informations as shown in Table 2.

TABLE 2

Allotment of Instrument Groups

| RHYTHM KIND | 0 MARCH TANGO | | 1 WALTZ BALLADE | | 2 SWING | | 3 LATIN ROCK DISCO 16 BEAT | | 4 BOUNCE SLOW ROCK 8 BEAT | | 5 BOSSANOVA | | 6 SAMBA | | 7 LATIN | |
|---|---|---|---|---|---|---|---|---|---|---|---|---|---|---|---|---|
| C H | TOP | W | TOP | W | TOP | W | TOP | W | TAMBOU- | C | TAMBOU- | C | TAM- | W | CLAVES | C |
| 0 | CYMBAL | | CYMBAL | | CYMBAL | | CYMBAL | | LINE | | LINE | | LINE | | | |
| 1 | H H | W | H H | W | H H | W | H H | W | H H | W | H H | W | H H | W | MARACAS | C |
| 2 | S D | W | S D | W | S D | W | CONGA | W | S D | C | CASABA | W | CASABA | W | TYMBAL | W |
| | BRUSH | | BRUSH | | BRUSH | | | | RIM | | | | | | | |
| | OUT | | OUT | | OUT | | | | | | | | | | | |
| 3 | S D | W | S D | W | S D | W | S D | W | S D | W | S D | W | S D | W | BONGO | C |
| | LIGHT | | LIGHT | | LIGHT | | HEAVY | | HEAVY | | MEDIUM | | MEDIUM | | | |
| 4 | B D | W | B D | W | B D | W | B D | W | B D | W | B D | W | B D | W | CONGA | W |
| | LIGHT | | LIGHT | | LIGHT | | HEAVY | | HEAVY | | HEAVY | | LIGHT | | | |
| 5 | CASTANET | W | S D | C | CRASH | W | CRASH | W | CRASH | W | TRIANGLE | C | AGOGO | C | GUILLO | C |
| | | | BRUSH | | CYMBAL | | CYMBAL | | CYMBAL | | | | | | | |
| | | | ROLL | | | | | | | | | | | | | |
| 6 | H H | C | H H | C | H H | C | TAM-TAM | W | TAM-TAM | W | S D | C | TAM-TAM | W | COWBELL | C |
| | PEDAL | | PEDAL | | PEDAL | | | | | | RIM | | | | | |
| 7 | S D | C | S D | C | S D | C | FLOOR | W | FLOOR | W | FLOOR | W | FLOOR | W | FLOOR | W |
| | RIM | | RIM | | RIM | | TOM | | TOM | | TOM | | TOM | | TOM | |

C . . . Central loudspeaker
W . . . Left loudspeaker
H H . . . High hat
S D . . . Snare drum
B D . . . Bass drum The instrument name display data memory 44 is comprised of a ROM storing the data indicative of the instrument names in either Romanized letters or Katakana letters correspondingly to, for example, altered channel numbers CHNO*. These data are used to display on the display unit 28.

(3) Details of the rhythm interface 41

Figure 5:
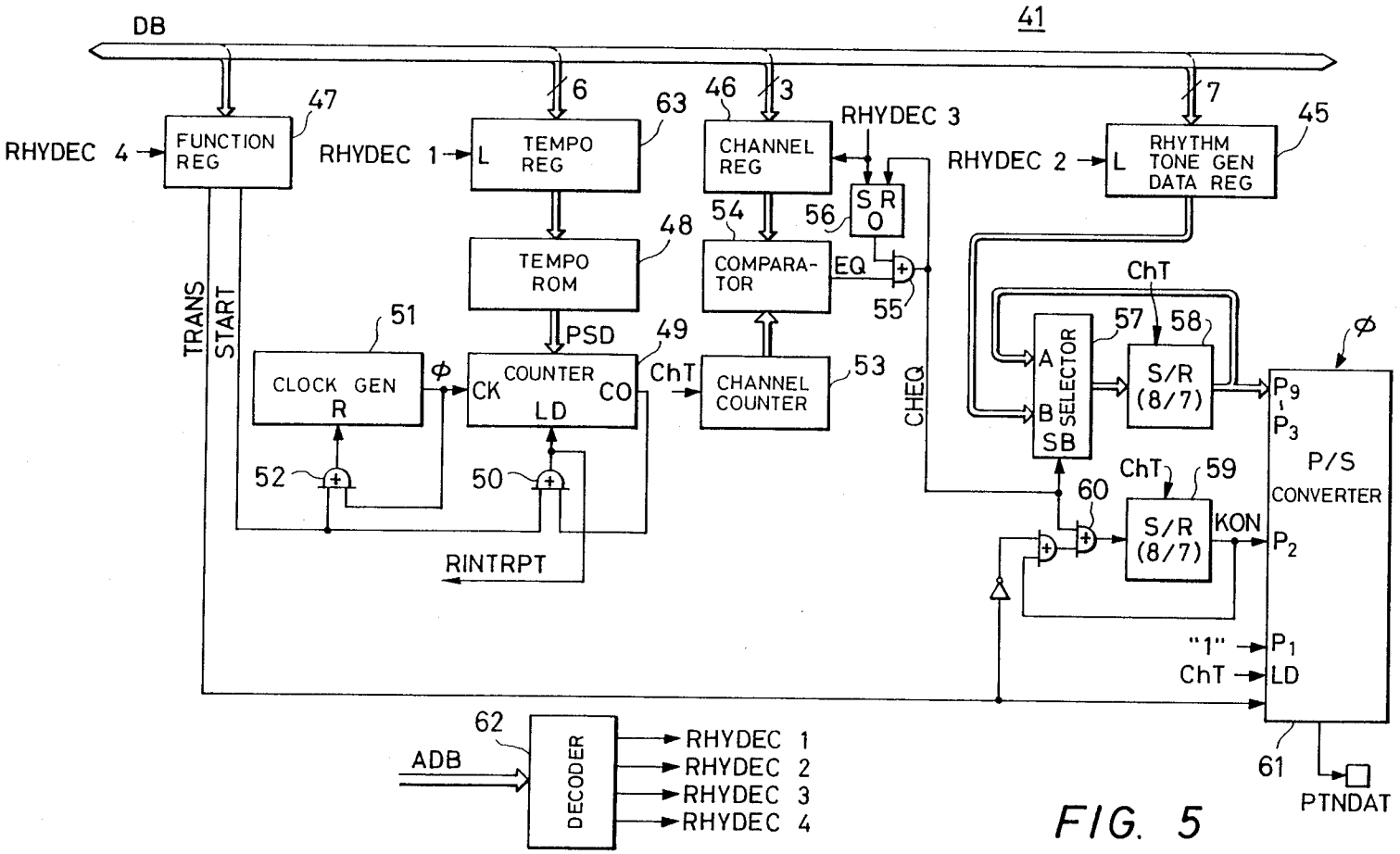
FIG. 5 is a detailed block diagram showing the rhythm interface provided in the apparatus of FIG. 2.

FIG. 5 shows the detailed construction of the rhythm interface 41. In FIG. 5, a decoder 62 functions in such a way that, when the address signal which is delivered out by CPU 31 (FIG. 2) to the address bus ADB is either one of the addresses of a tempo register 63, a rhythm tone generator data register 45, a channel register 46 and a function register 47, said decoder delivers out a load signal RHYDEC "1"–"4" to the respective registers 63, 45–47 in accordance with said address signal. Accordingly, the data delivered out by CPU 31 via the data bus DB is stored in the register whose address is designated by CPU 31.

The tempo register 63 stores, each time the contents of the tempo data register TEMPO are altered, fresh tempo data TEMPO, and a tempo ROM 48 converts the tempo data TEMPO outputted from the tempo register 63 to a presetting data PSD for a counter 49. This counter 49 functions in such a way that, when the load terminal LD, i.e. the output of an OR circuit 50, is "1", the presetting data PSD is preset therein, and subsequent thereto it counts the clock signals $\phi$ of a predetermined constant frequency which are outputted by a clock generating circuit 51, and when count overflows, the latter counter outputs "1" at its output terminal $C_0$. This output is inputted to one of the input terminals of the OR circuit 50, and the counter 49 is preset at each occurrence of overflow. More particularly, this counter 49 functions in such a way that, if the overflow value is assumed to be "N" and the presetting value as "M", it divides the frequency of the clock signal $\phi$ into "1/(N−M)", and produces an output of the tempo which has been set by the tempo setting knob 27 (FIG. 3). This counter 49 may be of the type which functions so that, after being preset, it down-counts the clock signals $\phi$, and when the count value becomes "0", it outputs "1" at its output terminal $C_0$ and divides the clock signal $\phi$ into "1/M", or the counter may be of any other variable frequency divider type. The other input terminal of the OR circuit 50 is connected to the "start" output terminal of the function register 47, to preset the counter 49 also when the function register 47 generates a "start" signal START which will be described later. The output of this OR circuit is delivered out further as an interrupt signal RINTRPT to CPU 31 which, in turn, commences an interrupt processing action (which will be described later) at the same time that the counter 49 is preset. The output of the clock generating circuit 51 is inputted to one of the input terminals of an OR circuit 52. Since the output of this OR circuit 52 is applied to the presetting terminal of the clock generating circuit 51, this clock generating circuit 51 is reset immediately upon generation of its output. Thus, this circuit 51 generates a clock signal $\phi$ of a small pulse width. Also, to the other input terminal of this OR circuit 52 is inputted the abovesaid "start" signal START. Accordingly, at the time the "start" signal START is generated, the counter 49 is preset, and along therewith the clock generating circuit 51 also is reset.

The event datum read out from the rhythm pattern memory 34 by CPU 31 (FIG. 2) is stored in the rhythm tone generator data register 45 as a 7-bit datum consisting of 3 bits representing "level" LEVEL and the remainder 4 bits representing "pitch" PITCH. Also, the altered channel number CHNO* which is produced by CPU 31 by reference to the instrument data memory 43 is stored temporarily in the channel register 46. A channel counter 53 repetitively counts channel timing signal ChT from "0" up to "7". A comparator 54 compares the output of this channel counter 53 with the altered channel number CHNO* which is outputted from the channel register 46, and when there is coincidence therebetween, it delivers out a channel coincidence signal CHEQ via an AND circuit 55. A flip-flop 56 is set by a load signal $RHYDEC_3$ generated from the channel register 46, and is reset by the abovesaid channel coincidence signal CHEQ. The channel coincidence signal CHEQ is outputted as a logical product of the output of the comparator 54 and the setting output Q of the flip-flop 56. As such, there is outputted, only once after the altered channel number CHNO* has been loaded, a channel coincidence signal CHEQ as a differentiated waveshape at the leading edge of the channel timing signal ChT. This channel coincidence signal CHEQ is inputted to an SB terminal of a selector 57. And, only when this channel coincidence signal CHEQ is generated, those data such as the "level" LEVEL and "pitch" PITCH which have been stored in the rhythm tone generator data register 45 are loaded in an 8-staged 7-bit shift register 58. Also, the channel coincidence signal is stored, via an OR circuit 60, in an 8-stage/1-bit shift register 59 as a key-on signal KON. These shift registers 58 and 59 and the channel counter 53 are each actuated by a same channel timing signal ChT. Therefore, the data stored in the rhythm tone generator data register 45 are loaded in that channel corresponding to the altered channel number CHNO* stored in the channel register 46 in synchronism with the channel timing for the shift registers 58 and 59.

The function register 47 takes in the data which are delivered out, via the data bus DB, from CPU 31 when the output $RHYDEC_4$ of the decoder 43 is "1" as CPU 31 designates the address. When this data has the value "$01", said register delivers out a "start" signal START which is a pulse of a short time length, and thereafter the register 47 is automatically cleared. When, on the other hand, the data value is "$20", the functional register 47 outputs a transfer signal TRANS for a period of time in which the total data of the shift registers 58 and 59 for eight (8) channels are outputted as serial outputs from a P/S (parallel to serial) converter 61 which will be described later, and thereafter the function register is automatically cleared.

The P/S converter 61 is inputted, at its parallel data input terminals $P_2$–$P_9$, with the rhythm data which have been stored in the shift registers 58 and 59 for each one of the eight (8) channels, successively for one channel after another in synchronism with the channel timing signal ChT. Also, the channel timing signal ChT is inputted to the loading terminal LD of the converter 61. And, when the function register 47 generates a transfer signal TRANS, this P/S converter 61 takes in the data for $P_1$–$P_9$ in an amount for one (1) channel during the period of time when the channel timing signal ChT remains to be "1", and converts said taken-in data to serial data PTNDAT during the period of time when the channel timing signal ChT is "0" and delivers out the serial data at the timing of the clock signal $\phi$ to the rhythm tone producing circuit 70. By repeating the abovesaid actions eight (8) times, data for the whole eight (8) channels are delivered out.

It should be noted here that the terminal $P_1$ is normally inputted with "1" either as a marker or as an input recognition signal. For this reason, in the rhythm tone producing circuit 70, it will be noted that, when the serial data is transferred thereto, the successively inputted datum "0" changes to "1" at least at $P_1$. Thus, even when the datum at each of the terminals $P_2$–$P_9$ is invariably "0", it is possible to identify, by virtue of the datum "1" inputted to the initial terminal $P_1$, that the data "0" at the remainder terminals are all effective data that have been transferred from the rhythm interface 41.

(4) Rhythm tone producing circuit 70

Figure 6:
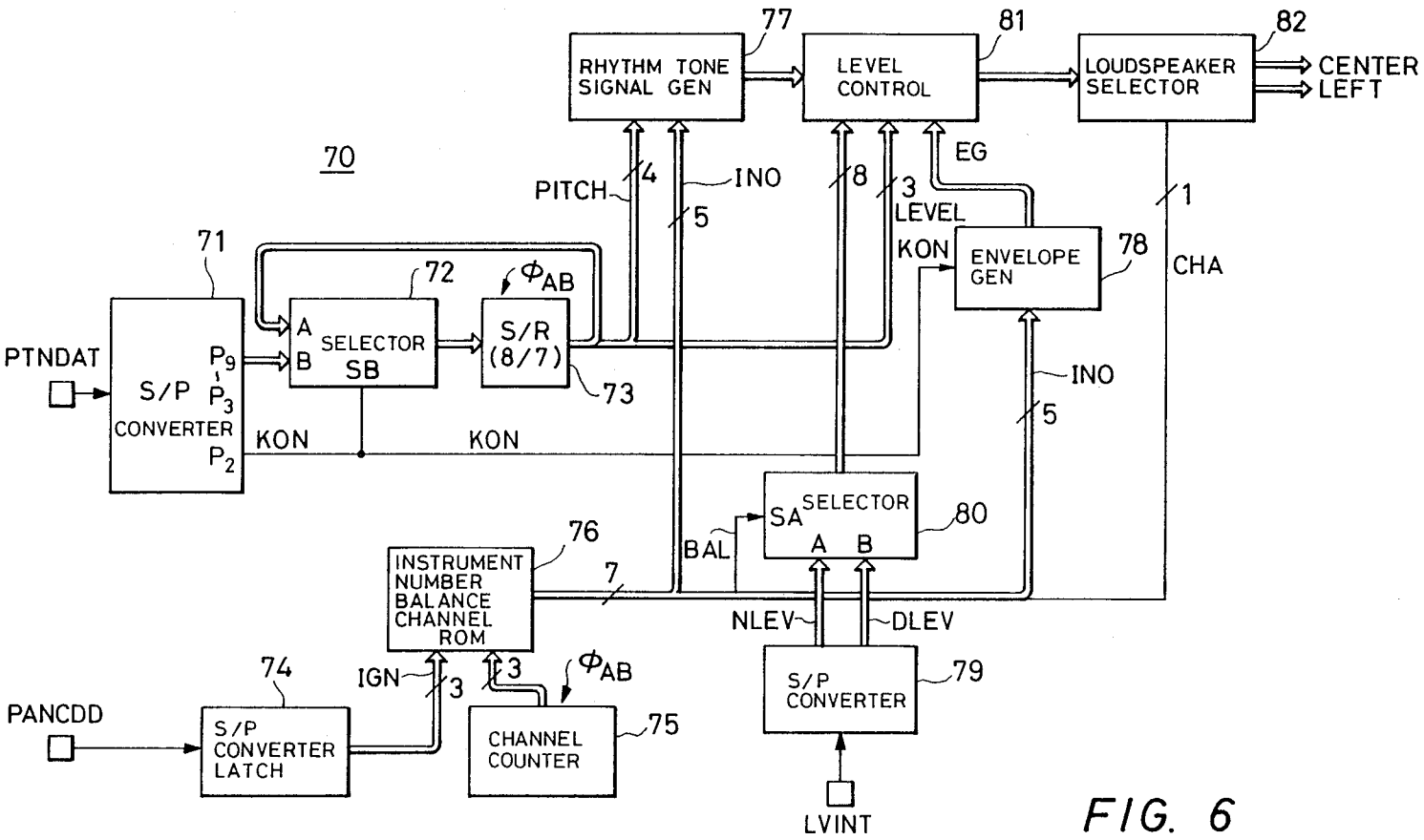
FIG. 6 is a detailed block diagram of the rhythm tone producing circuit provided in the apparatus of FIG. 2.

FIG. 6 shows detailed block diagram of the rhythm tone producing circuit 70. This rhythm tone producing circuit 70 comprises an S/P (serial to parallel) converter 71, a selector 72, an 8-stage/7-bit shift register 73, an S/P conversion latch circuit 74, a channel counter 75, an instrument number balance channel ROM 76, a rhythm tone signal generating circuit 77, an envelope generator 78, an S/P conversion circuit 79, a tone volume selector 80, a level control circuit 81 and a loudspeaker selector 82. The circuit 70 is inputted with those rhythm-related data PTNDAT, LVINT and PANCDD which are delivered out serially from the rhythm interface 41 and also from the panel data interface 42 of the control unit 30 (FIG. 2), and generates a percussion instrument tone signal in each of the eight (8) time-divisional channels.

This rhythm tone producing circuit 70 as a whole is driven by a clock signal $\phi_{AB}$, and eight (8) rhythm tone generator forming channels are time-divisionally formed for each of the time slots which are so sectioned in a successive order for every one period of said clock signal $\phi_{AB}$. The eight (8) kinds of percussion instruments are allotted to these eight (8) channels, respectively, one instrument for one channel.

The S/P converter 71 converts the serial data PTNDAT which are transferred from the rhythm interface 41 (FIG. 2) to parallel data and store them temporarily in a buffer memory containing therein the parallel data for eight (8) channels, and delivers out the data in an amount for one channel at a time to each of the output terminals $P_9$–$P_2$ in synchronism with the outputs of the channel counter 75.

The selector 72 functions so that, because the select terminal DB is usually "0", it outputs therefrom a signal which is inputted to its input terminal A. Accordingly, the shift register 73 stores the signals which have been inputted once therein while circulating the signals by shifting them successively one after another for each arrival of the clock signal $\phi_{AB}$. This shift register 73 functions in such a manner that, when a key-on signal KON is generated at the output terminal $P_2$ of the S/P converter 71 and when accordingly the select terminal SB of the selector 72 is at "1", the shift register 73 is inputted with the rhythm tone generator data which is generated at the output terminals $P_9$–$P_3$ of the S/P converter 71. In this case, in order to establish coincidence between the rhythm interface 41 (FIG. 2) on the delivery side and the channel, such coincidence is achieved by, for example, generating a transfer signal of the function register 47 (FIG. 5) in synchronism with the channel "0" of the count of the channel counter 53, and transferring the data from channel "0" up to channel "7" unfailingly in this order, while causing, in the rhythm tone producing circuit 70 of the receiver side, the S/P converter 71 to deliver its outputs in synchronism with either the outputs of the channel counter 75 in successive order beginning at channel number "0" or in synchronism with the system clocks $\phi_{AB}$.

The S/P conversion latch circuit 74 converts the 8-bit serial data PANCDD including the instrument group number data IGN which are transferred from the panel data interface 42 (FIG. 2) to a parallel data, and along therewith latches this parallel data until the serial data PANCDD is inputted next.

The channel counter 75 counts the system clock signals $\phi_{AB}$ and outputs channel numbers CHNO* of "0"–"7".

The instrument number balance channel ROM 76 is a conversion ROM which functions in such a way that, when the instrument group number IGN and the channel count value are inputted therein, it generates 5-bit instrument number INO, i.e. instrument name, one-bit tone generator group signal BAL indicating which one of the cymbal (noise) family and the drum family said instrument belongs to, and also generates one-bit pronunciation control signal CHA indicating which one of the central and the left loudspeakers is to pronounce the tone of this instrument.

The rhythm tone signal generating circuit 77 generates a percussion instrument tone waveshape based on 5-bit instrument number INO outputted from the instrument number balance channel ROM 76 and 4-bit pitch data PITCH outputted from the shift register 73. This rhythm tone signal generating circuit 77 may employ either the well-known waveshape memory system or the known algorithm-calculation system. In case the waveshape memory system is employed, the start-end address of the memory is designated by the instrument number INO and the pitch data PITCH. Whereas, in case of the algorithm-calculation system, the determination of pitches and also the setting of constants for determining tone color are carried out by virtue of the instrument number INO, while the pitch data PITCH is used for making some modification of pitches.

The envelope generator 78 uses, as an attack, the key-on signal KON which is generated at the output terminal $P_2$ of the S/P converter 71 to generate an envelope data which is determined by the instrument number INO outputted from the instrument number balance channel ROM 76.

The S/P conversion circuit 79 converts, to parallel data, the serial data LVINT comprised of cymbal family tone volume NLEV and drum family tone volume DLEV which are outputted from the panel data interface 42, and stores the parallel data temporarily.

The tone volume selector 80 selects either the cymbal family tone volume NLEV or the drum family tone volume LEV in accordance with the tone generator group signal BAL which is generated from the instrument number balance channel ROM 76, and delivers out the selected datum to the level control circuit 81.

The level control circuit 81 is comprised of, for example, a multiplier. It carries out calculation, for each channel, of: the tone generator waveshape data supplied from the rhythm tone signal generating circuit 77; either the cymbal family tone volume NLEV or the drum family tone volume DLEV supplied from the tone volume selector 80; the level data LEVEL coming from the shift register 73 and the envelope data EG received from the envelope generator 78, and generates time-divisionally multiplexed percussion instrument tone signals.

The loudspeaker selector 82 outputs, based on the tone producing channel signal generated by the instrument number balance channel ROM 76, percussion instrument tone signals generated by the level control circuit 81 by allotting them to the central and left channel sound systems 90 and 95 (FIG. 2).

Next, description will be made of the electronic musical instrument shown in FIG. 2 by referring to the flow charts of FIGS. 7 to 12, especially centering around the control unit 30.

Figure 7:
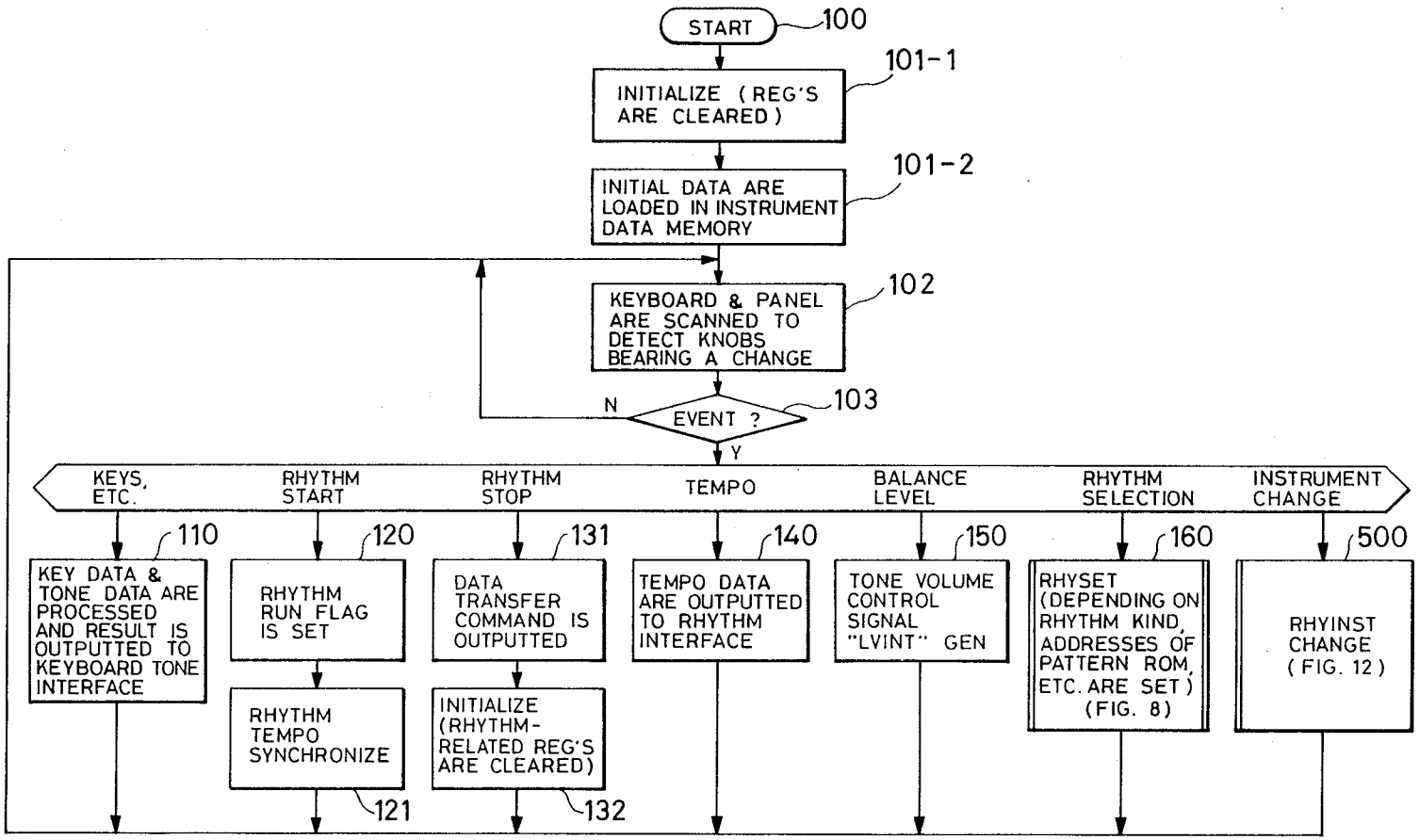
FIGS. 7 to 12 are flow charts for explaining the operation of the apparatus of FIG. 2.

By referring now to FIG. 7, upon connection of this electronic musical instrument to a power supply not shown, CPU 31 commences its actions in accordance with the control program stored in the program memory 32 (Step 100). In Step 101-1, CPU 31 clears the respective registers, flags, etc. of the working memory 33, the rhythm interface 41, etc. to thereby initialize the whole circuitry. In Step 101-2, initial data are loaded in the instrument data memory 43. In Step 102, the keyboard unit 10 and the respective manipulating knobs of the control panel 20 are scanned to detect those knobs which have been altered of their state (manipulated) and the informations accruing from such manipulating knobs. This detection can be performed in such a way that the instance wherein the exclusive logical sum of, for example, the information concerning each manipulating knob and the preceding manipulating knob informations stored in the respective registers TEMPO, TOTLEV, RHDLEV, RHCLEV, RHYPTN, etc. is not "0" is taken for representing the presence of an alteration of manipulating knob informations, i.e. the presence of an "event". In Step 102, even in case the rhythm start-stop switch 24 is turned in its position to the "stop" side, a manipulating knob information of such an instance is detected also, and furthermore, detection is made also of the manipulation, etc. of the instrument change-mode selection switch 29*m*. Manipulating knob informations are such that, for example, the values set by the total volume 26 and the balance setting knob 25 are indicated by digital data "0"–"15", respectively, and these data are stored in the total tone volume register TOTLEV, the drum family tone volume ratio register RHDLEV and the noise family tone volume ratio register RHCLEV.

In Step 103, judgment is made whether an "event" has been detected in Step 102. In case of no event, processing returns to Step 102 to make further detection of event. If there is noted an event, processing complying with the type of the detected event is carried out in subsequent Steps.

In case the "event" detected in Step 102 represents an alteration of a tone due to either the depression or release of a key or keys or due to the manipulation of the tone selection knob 21, processing proceeds to Step 110. In Step 110, respective key data or tone selection data are processed and the result is outputted to the key tone interface 40. The key tone interface 40 delivers out these data further to a keyboard tone forming circuit 65.

In case the abovesaid "event" indicates a "start" command by the start-stop switch 24, the rhythm run flag RHYRUN in the working memory 33 is set in Step 120, and thereafter the rhythm tempo is synchronized. This synchronization is performed by the following procedures that the data $01 is loaded in the function register 47 (FIG. 5) of the rhythm interface 41 to cause the function register 47 to generate a start signal START, and the counter 49 and the clock generator 51 are reset by said start signal. Also, due to the generation of this "start" signal START, an interrupt is applied to CPU 31 from the rhythm interface 41, and the CPU 31 delivers out respective serial data PTNDAT, LVINT, PANCDD, etc. concerning a rhythm tone to the rhythm tone producing circuit 70 via the rhythm interface 41 and the panel data interface 42 by virtue of the interrupt processing RHIRQ made in Step 200 of FIG. 9 and subsequent Steps.

In case the "event" in Step 102 represents "rhythm stop" by the start-stop switch 24 (FIG. 3), a data transfer command signal is delivered out in Step 131. This is performed by loading the datum "$20" in the function register 47 (FIG. 5) of the rhythm interface 41. As a result thereof, rhythm tone generator data PTNDAT is transferred to the rhythm tone producing circuit 70. Furthermore, in Step 132, those registers and flags concerning rhythms such as the rhythm run flag RHYRUN shown in Table 1 are cleared.

In case the "event" in Step 102 indicates an alteration of tempo due to the tempo setting knob 27, tempo data TEMPO is loaded in the tempo register 63 (FIG. 5) of the rhythm interface 41 in Step 140. By dint of the tempo data stored in this tempo register 63, a tempo for reading out one (1) sub-beat pitch, i.e. rhythm pattern, is determined.

In case the "event" in Step 102 represents either an alteration of the total volume 26 or an alteration of the setting value of the balance setting knob 25, the values TOTLEV, RHDLEV and RHCLEV of these respective manipulating knobs are converted to logarithms by referring them to the logarithmic tone volume memory 36, respectively, and thereafter they are added together (notes: multiplied for tone volume) to obtain cymbal family tone volume NLEV and drum family tone volume DLEV, and they are converted to serial data LVINT and are delivered out to the rhythm tone producing circuit 70.

Figure 8:
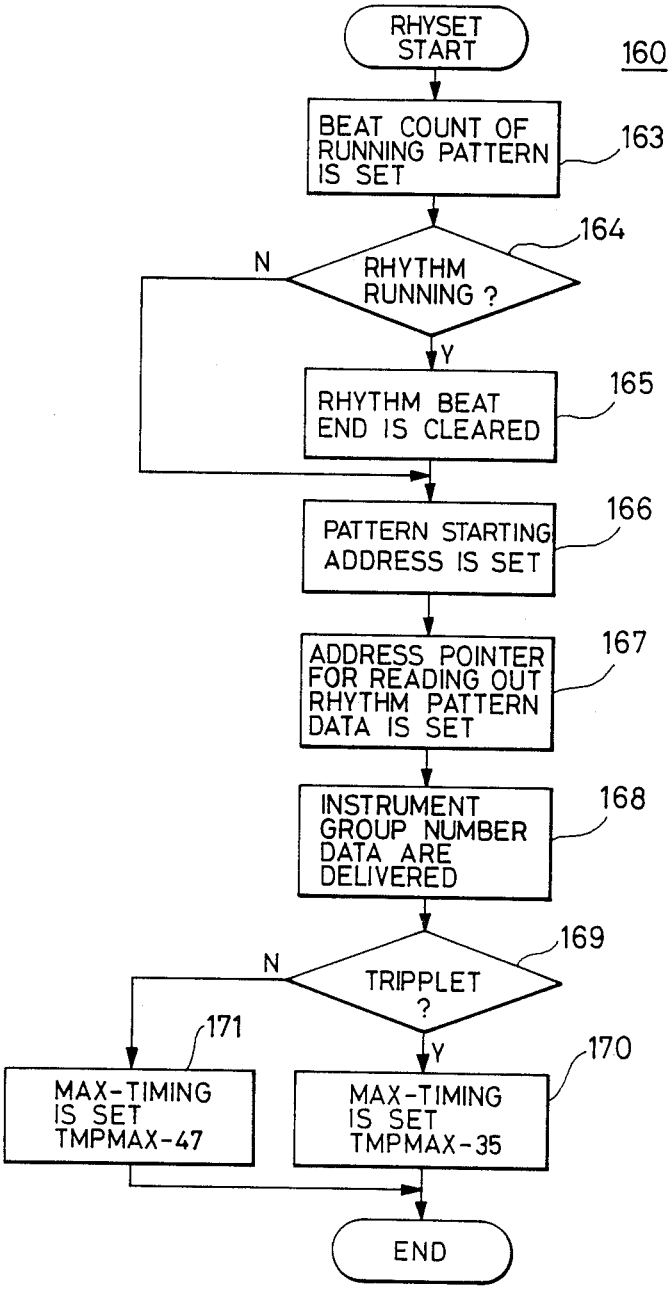

In case the "event" in Step 102 is an alteration of rhythm kind RHYPTN due to the manipulation of the rhythm selection switch 23, rhythm setting processing RHYSET 160 shown in FIG. 8 is carried out. More particularly, in Step 163, by referring to the contents of the intra-measure timing counter RIMING, the beat count of the beat count register HKPE is set to "1" if timing TIMING is "0"–"11", or to "2" if timing is "12"–"23", or to "3" if timing is "24"–"25", or to "4" if timing is "36"–"47", respectively. This is for the purpose of continuing the playing of the altered rhythm at the same timings as those used prior to the alteration of the rhythm. These data are used when the pattern pointer PHPNT is set in Step 167 to the address in which the rhythm pattern data of the same beat count and same intrabeat timings are stored. In Step 164, the rhythm run flag RHYRUN is checked, and if the rhythm is noted to be running, the beat-end flag RHHEND is cleared in Step 165. This is because of the reason that, if the beat-end flag RHHEND remains in its set state, there arises the inconvenience that, in case the altered rhythm does have an event datum in the subsequent stage to the timing which was set when the rhythm was altered, the reading-out of such an event datum would base skipped (see Step 401). In case there is present no event datum either in the altered rhythm in the stages subsequent to the timing set at the time of alteration of the rhythm, the beat-end flag RHHEND is set when the rhythm pointer RHPNT is set. If the result of judgment in Step 164 indicates that "rhythm is being suspended", it should be noted that, since the beat end flag RHHEND has been cleared already in Step 132 when "rhythm stop" processing is carried out, Step 165 is skipped and processing proceeds to Step 166.

In Step 166, the top pattern address memory 35 is addressed with the contents RHYPTN of the rhythm kind register to read out the top address of the selected rhythm kind, and the result is stored in the top address register RHYROM. In Step 167, the rhythm pattern memory 34 is designated by the address indicated by the sum of the top address RHYROM and the pattern pointer RHPNT, and data are read out one after another in succession beginning at the starting address thereof. The count of the beat-end data BE and the intra-beat timing TIMING which have been read out are compared against the beat count HKPE and the timing, to set the pattern pointer RHPNT. In Step 168, the instrument group number IGN stored at the starting address RHYROM of the rhythm pattern memory 34 is read out, and the result is outputted to the panel data interface 42. The panel data interface 42 converts this instrument group number IGN to serial data PANCDD, and the result is delivered out to the rhythm tone producing circuit 70. In Step 169, judgment is made whether the rhythm kind RHYPTN is either the three (3)-beat rhythm (tripplet) or the four (4)-beat rhythm (quadruplet), and if it is a three (3)-beat rhythm, "35" which is the maximum timing count within one bar (measure) is stored in the maximum timing register TMPMAX in Step 170, while if it is a four (4)-beat rhythm, maximum timing count "47" is written likewise in said timing register TMPMAX in Step 171.

After the detection of an event in Step 102, processing in Steps 110–171 for every kind of event is completed. Whereupon, processing returns again to Step 102 to perform the detection of a fresh event.

As stated earlier, in the electronic musical instrument shown in FIG. 2, an interrupt signal RINTPT is delivered out from the rhythm interface 41 to CPU 31 when the start-stop switch 27 is switched to the "start" position and also when the counter 49 counts 1/12 of one beat, i.e. one sub-beat, in accordance with the set tempo. Accordingly, CPU 31 carries out the interrupt processing INTRPT 200 of FIG. 9 for every one sub-beat at the time of the start of rhythm and also in the stages subsequent thereto.

In Step 201 to begin with, the respective registers, program counter, etc. are saved so as to ensure that they are able to store their initial state also after the completion of the interrupt processing. In succession thereto, the rhythm tone producing data output processing RHIRQ 210 shown in FIG. 10 is carried out.

Figure 9:
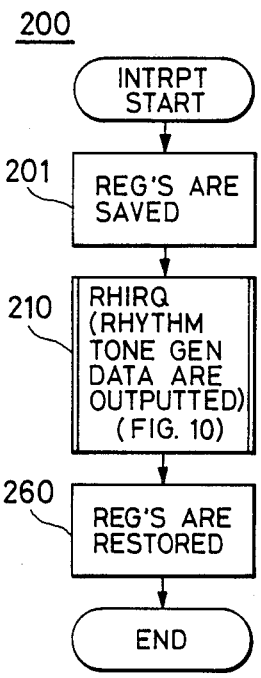
Figure 10:
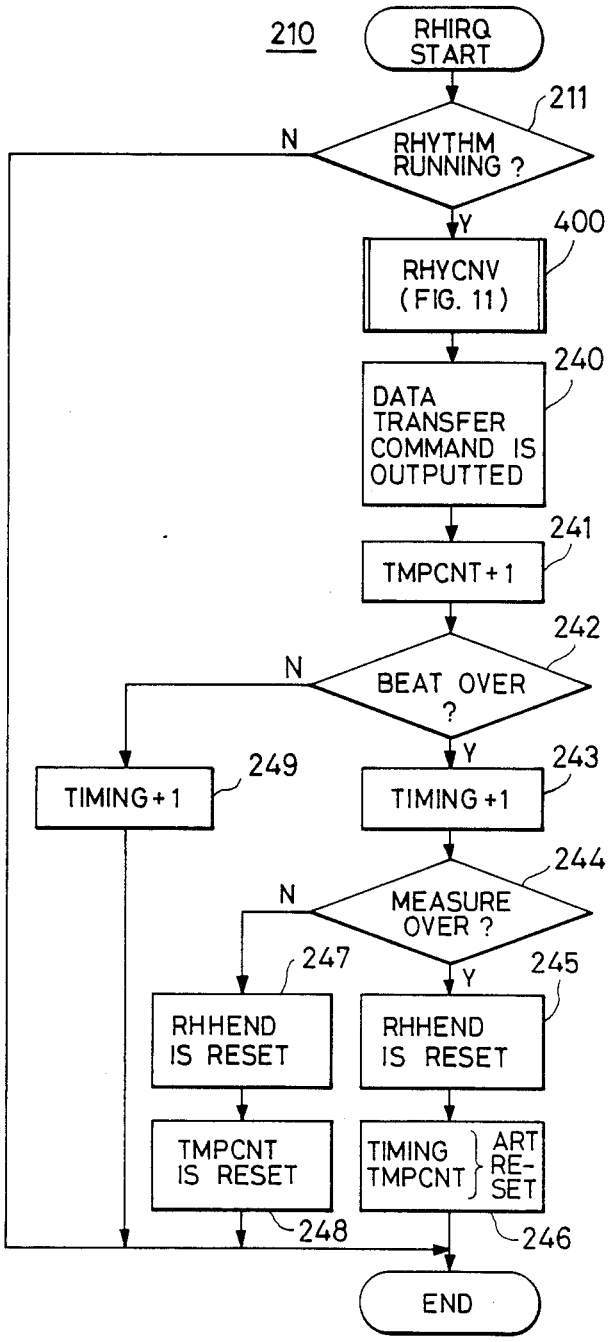

Reference is hereby made to FIG. 10. In Step 211, the rhythm run flag RHYRUN is checked to judge whether a rhythm is running. If the result of this judgment indicates "NO", i.e. in case the rhythm is suspended, there is no need to output rhythm tone data, and accordingly this processing RHIRQ 210 is finished, and the interrupt is immediately released in Step 260 (FIG. 9), and processing returns to the initial routine of either FIG. 7 or FIG. 8. If the rhythm is noted to be running in Step 211, processing proceeds to the rhythm data output sub-routine RHYCNV 400 (FIG. 11).

Figure 11:
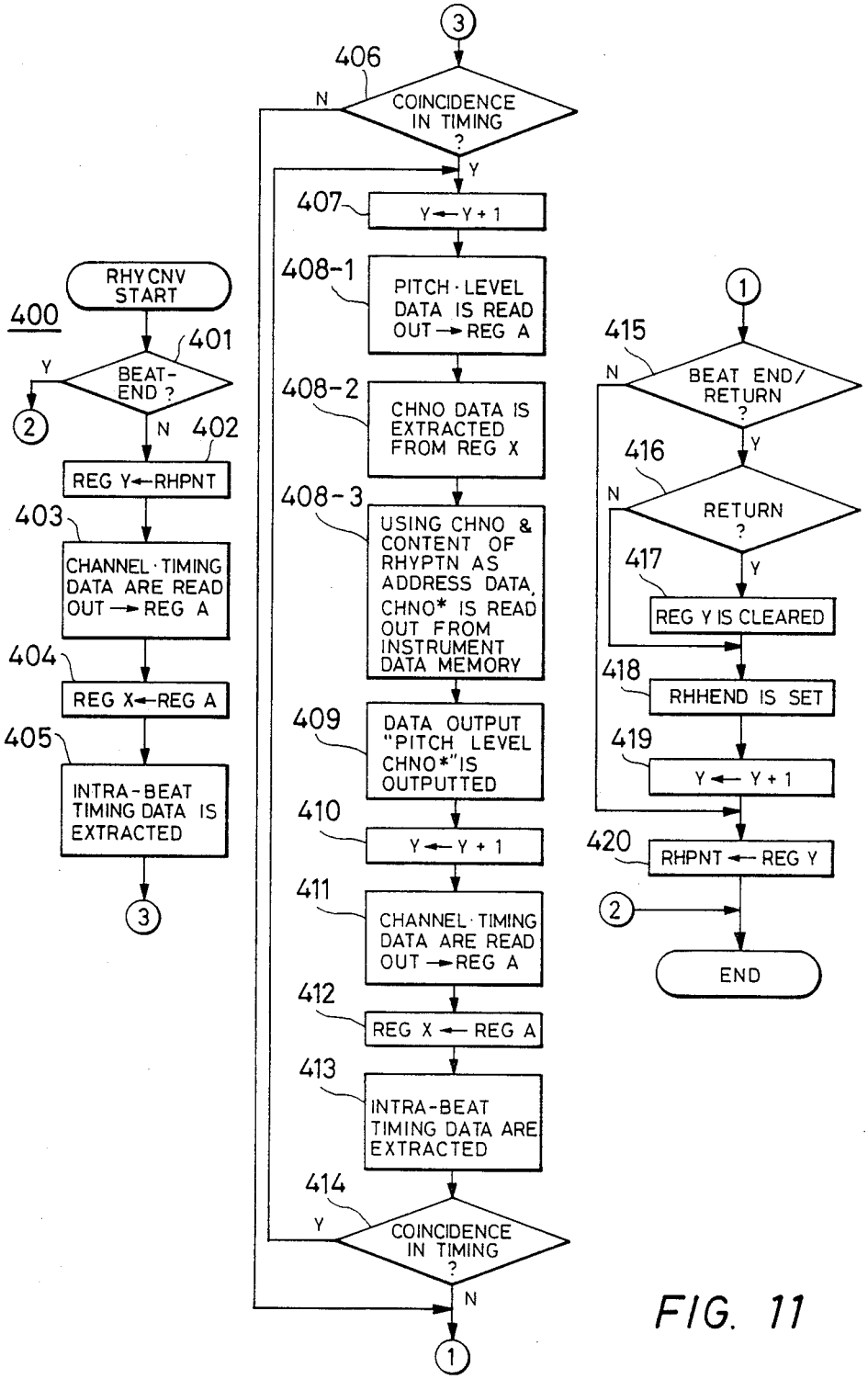

By referring now to FIG. 11, it should be noted that in Step 401, the beat-end flag RHHEND is checked. If the result indicates "beat-end", there is present no event data in the timings TMPCNT in the subsequent stages up to "over-beat", and accordingly processing directly returns to the initial routine (FIG. 10). If the result of the checking does not indicate "end of beat", the contents of the rhythm pointer RHPNT are set in the register Y in Step 402, and in succession thereto, the rhythm pattern memory 34 is addressed by the sum of the top address RHYROM of the read-out pattern and the contents of the register Y (i.e. the contents RHPNT of the rhythm pointer) to read out the channel data CHNO of the first byte and the intrabeat timing data HTIMING and store them in the register A and the register X. Next, in Step 405, logical product of the contents of the register A and "$OF" is obtained, and only the less significant 4-bit intra-beat timing data are left therein among the contents of the register A, and in Step 406, judgment is made whether said intra-beat timing coincides with the timing other than the left-over timing data indicated by the tempo counter TMPCNT. If there is coincidence between these timings in Step 406, this datum is indicating the timing TMPCNT which requires processing at present and thus effective. Therefore, in Step 407, the contents of the register Y serving as a pointer are advanced, and in Step 408-1, the pitch datum PITCH and the level datum LEVEL of the second byte in the event data EVT of FIG. 4C are read out and stored in the register A. In Step 408-2, the channel datum CHNO is extracted from the register X, and in Step 408-3, this channel datum CHNO and the contents of the rhythm kind register RHYPTN are used as the address data to access the instrument data memory 43, to thereby read out the corresponding altered channel number CHNO* In Step 409, on the other hand, the pitch data PITCH and the level data LEVEL which have been stored in the register 45 (FIG. 5), and the altered channel number CHNO* which has been read out from the instrument data memory 43 by the above-mentioned procedure is outputted to the channel register 46 (FIG. 6).

In Step 410, furthermore, in order to read out the next event data EVT, the contents of the register Y serving as the rhythm pointer are advanced further. In Steps 411–414, the procedures of Steps 403–406 are repeated, and in Steps 407–414, all of the event data EVT having the same intra-beat timing as the current timing TMPCNT are read out. In case there does not exist any event datum having the same intra-beat timing in either the Step 406 or Step 414, processing proceeds to Step 415, wherein judgment is made whether the timing data left in the register A in either Step 403 or Step 413 are "$OD" or greater. Since the intra-beat timing is always "$O"—"$B", it is when either the beat-end data BE or the return data RNT is read out that the contents of the register A becomes "$OD" or greater. Now, therefore, in case, in the above-mentioned judgment, register A≧$OD, judgment is next made in Step 416 whether register A=$OF. If register "A=$OF, i.e. "return", register Y is cleared in Step 417. Whereas, if register A≠$OF, i.e. "beat-end", processing skips Step 417 and proceeds onto Step 418. In Step 418, the beat-end flag RHHEND is set, and in Step 419 the contents of the register Y are advanced, and in Step 420 the contents of the register Y are set in the rhythm pointer RHPNT, and then processing returns to the initial routine (Step 240 of FIG. 10). When the return datum RNT is detected by the processing in the above-mentioned Steps 417, 419 and 420, the rhythm pointer PHPNT is set to "1", whereas in case the beat-end datum BE is detected, the rhythm pointer RHPNT will indicate in Step 419 the next address of the address at which the beat-end datum BE is stored. If the judgment in Step 415 indicates that the intra-beat timing is not "beat-end/return", processing advances to Step 410, wherein the address used when the intra-beat timing which does not coincide with the timing TMPCNT was read out is stored, as it is, in the rhythm pointer PHPNT, and thereafter processing returns to Step 240 intended for the routine of FIG. 10.

Referring now to FIG. 10, in Step 240, a data transfer command signal is delivered out to the rhythm interface 41. This delivery is performed by designating the function register 47 (FIG. 5) by an address and loading "$20" therein. Whereupon, the function register 46 outputs a transfer signal TRANS, and this signal is applied to the P/S converter 60. And, such data as the pitch datum and the level datum which have been outputted to the rhythm interface 41 and stored in the shift register 58 for each channel as well as the key-on datum KON which is stored in the shift register 59 are converted by the P/S converter 61 to 9-bit serial data PTNDAT, and the latter data is delivered out to the rhythm tone producing circuit 70 (FIG. 2).

In Step 241, the tempo counter TMPCNT is advanced, and in Step 242, judgment is made from the contents TMPCNT of the tempo counter whether there is "over-beat". Since the number of timings within one (1) beat is "12". It will be noted that, in case the timins TMPCNT indicated by the tempo counter overflow, this represents an "over-beat". When judgment in Step 242 indicates "over-beat", processing will advance the timing counter TIMING in the next Step 243. An "over-measure" is always an "over-beat" and moreover an "over-beat" could possibly be an "overmeasure" also. Therefore, in the next Step 244, whether the "over-beat" noted in Step 242 is an "over-measure" is judged by checking whether the contents TIMING of the timing counter has reached the maximum tempo count TMPMAX. If the result indicates an "over-measure", the beat-end flag RHHEND is reset in Step 245, and in the next Step 246, both the timing counter TIMING and the tempo counter TMPCNT are reset, and thereafter processing returns to Step 260 of FIG. 9. Also, in case the result of judgment indicates an over-beat but not an over-measure, the beat-end flag RHHEND is reset in Step 247, and the tempo counter TMPCNT is reset in Step 248, and thereafter processing returns to the Step 260 of FIG. 9.

If the result of judgment in Step 242 indicates that the count is not an "over-beat", the timing counter TIMING is incremented in Step 249, and thereafter processing returns to Step 260 of FIG. 9 in Step 250.

Referring now to FIG. 9, after having returned via Step 250 from Steps 211, 246, 248 and 249 intended for rhythm tone producing data output processing RHIRQ (FIG. 10), the program counter, the registers, etc. which have been shunked (saved) to carry out the interrupt processing INTRPT are restored in Step 260, and processing returns to those of FIGS. 7 and 8 which are prior to the application of interrupt.

Figure 12:
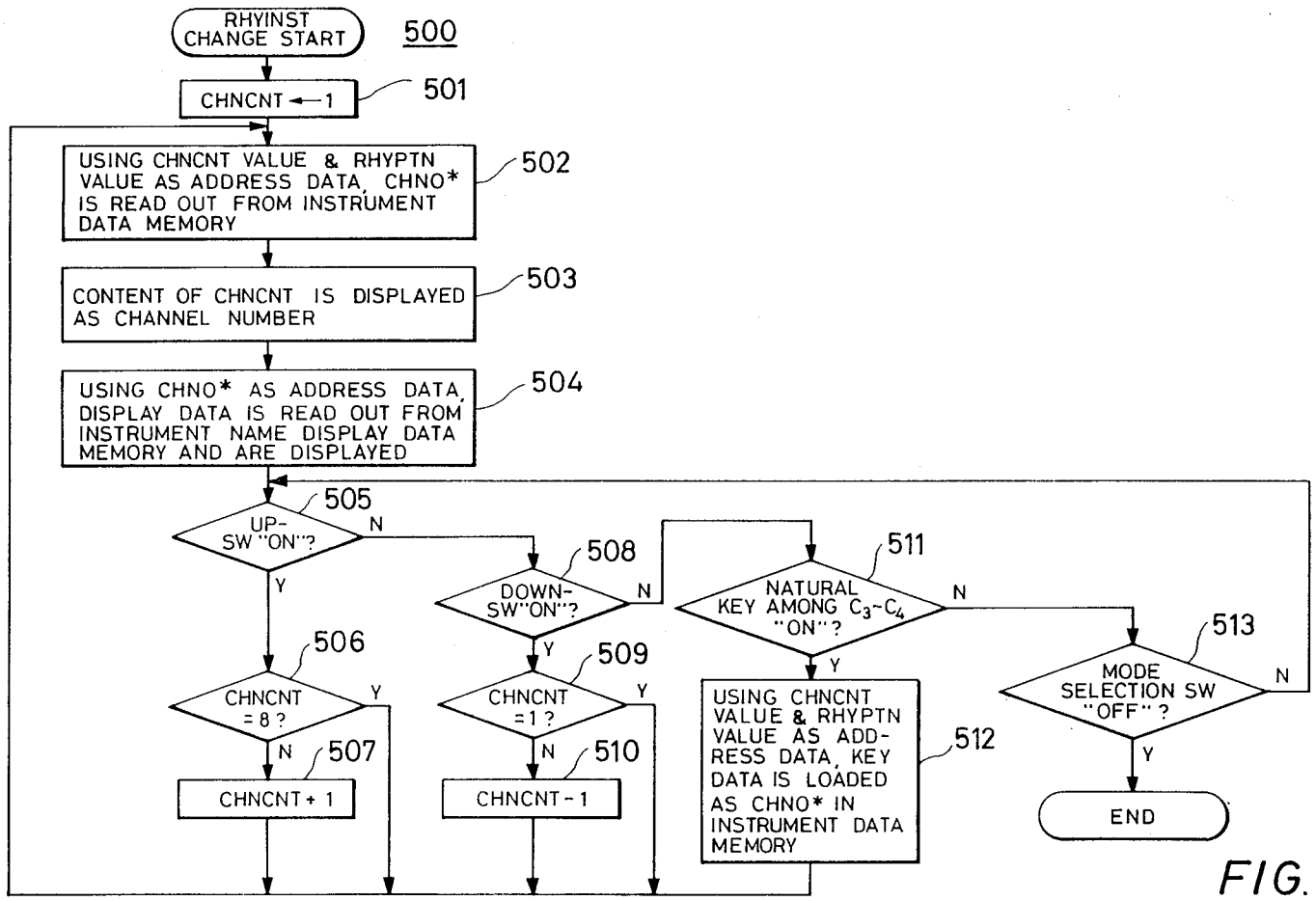

In case the "event" detected in Step 10 (FIG. 7) represents an alteration of musical instrument due to the manipulation of the instrument change-mode selection switch **29*m*, the rhythm instrument alteration routine RHYINST CHANGE 500 shown in FIG. 12 is carried out. In FIG. 12, it will be noted that in Step 501, the value of the contents of the channel number counter CHNCNT is set to "1". In Step 502, the value of the channel number counter CHNCNT and the value of the contents of the rhythm kind register RHYPTN are used as the address data, and the instrument data memory 43 (FIG. 2**) is accessed to read out the corresponding altered channel number CHNO*. In Step 503, the contents of the channel number counter CHNCNT are delivered to the display unit 28 via the display interface **39*b* and displays them as the channel number. Furthermore, in Step 504**, using the above-mentioned altered channel number CHNO* as the address datum, the display data is read out from the instrument name display data memory 44 (FIG. 2) and same is displayed by the display unit 28. Next, in Step 505, judgment is made whether the up-switch **29*u* (FIG. 3) is turned "on". If it is turned "on", judgment is made in Step 506 whether the value of the contents of the channel number counter CHNCNT is "8". If this value of contents is "8", processing returns immediately to those of the above-stated Step 502 and subsequent Steps. In case the value is not "8", the value of said contents is added with "1" in Step 507, and thereafter processing returns to the processing of Step 502 and subsequent Steps. In case the up-switch 29*u* is not turned "on" in Step 505, judgment is made in Step 508 whether the down-switch 29*d* (FIG. 3) is turned "on". If the down-switch 29*d* is turned "on", judgment is made in Step 509 whether the value of the contents of the channel number counter is "1". If this value of the contents is "1", processing returns to the processing of Step 502 and of subsequent Steps. In case the value of the contents is not "1", "1" is substracted from this value of contents in Step 510, and thereafter processing returns to those of Step 502 and of subsequent Steps. In case the result of judgment in Step 508 indicates that the down-switch 29*d* is not that the switch is, not turned "on", judgment is made in Step 511** whether any one of the natural keys ranging from $C_3$ inclusive to $C_4$ inclusive is rendered "on". If either one of these natural keys is rendered "on", the value of the contents of the rhythm kind register RHYPTN are used as the address data, and the key data corresponding to the depressed natural key is written as the altered channel number CHNO* in the instrument data memory 43 in Step 512, and then the processing of Step 502 and subsequent Steps is carried out. If, in Step 511, neither one of the natural keys is rendered "on", judgment is made whether the mode selection switch **29*m* (FIG. 5) is rendered "off" in Step 513. If this switch is rendered "off", the processing of this routine is completed and then processing returns to the Step 102 (FIG. 7). If, on the other hand, the mode selection switch 29*m* is not rendered "off", processing will again carry out those kinds of processing of Step 505** and subsequent Steps.

As described above, in the present invention, it will be noted that, by the depression of either one of the eight (8) natural keys of, for example, $C_3$ to $C_4$, it becomes possible that the channel numbers which have been preliminary allotted to these natural keys, respectively, are written as the altered channel numbers CHNO* in the desired addresses of the instrument data memory. Therefore, by a very simple operation, it becomes possible to set an altered rhythm tone generator which is driven based on the rhythm pattern and set same by the user. Thus, further diversification of the rhythm performance can be realized.

What is claimed is:

1. An automatic rhythm performing apparatus, comprising:

pattern memory means simultaneously storing a plurality of rhythm pattern data each of which indicates rhythm timings for tones of a corresponding rhythm instrument, each of said rhythm pattern data including a channel designation datum for a corresponding tone generation channel;

rewritable data memory means storing channel alteration data for altering at least one of said channel designation data in said rhythm pattern data;

pattern reading-out means for reading out rhythm pattern data from said pattern memory means;

instrument tone producing means for producing rhythm instrument tones for respective tone generation channels which have been designated by said rhythm pattern data and said channel alteration data; and data inputting means for rewriting the channel alteration data stored in said rewritable data memory means to alter at least one of said channel designation data in said rhythm pattern data.

2. An automatic rhythm performing apparatus according to claim 1, in which:

said rewritable data memory means stores channel alteration data for a plurality of rhythm kinds.

3. An automatic rhythm performing apparatus according to claim 1 or 2, in which:

said instrument tone producing means produces instrument tones corresponding to a plurality of tone generation channels having been designated in a time-division multiplexing fashion.

4. An automatic rhythm performing apparatus according to claim 1 and further comprising a keyboard unit having plural keys for performance by a player, in which:

said data inputting means comprises keys of the keyboard unit.

* * * * *